US012492440B2

(12) United States Patent
Hu et al.

(10) Patent No.: US 12,492,440 B2
(45) Date of Patent: Dec. 9, 2025

(54) ULTRA-HIGH STRENGTH STEEL AND FORMING METHODS AND APPLICATIONS OF SAME

(71) Applicant: NORTHWESTERN UNIVERSITY, Evanston, IL (US)

(72) Inventors: Xiaobing Hu, Evanston, IL (US); Shaozun Liu, Beijing (CN); Chunxu Wang, Beijing (CN); Yong Li, Beijing (CN); Vinayak P. Dravid, Glenview, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 981 days.

(21) Appl. No.: 17/606,509

(22) PCT Filed: May 4, 2020

(86) PCT No.: PCT/US2020/031285
§ 371 (c)(1),
(2) Date: Oct. 26, 2021

(87) PCT Pub. No.: WO2020/227195
PCT Pub. Date: Nov. 12, 2020

(65) Prior Publication Data

US 2022/0213569 A1 Jul. 7, 2022

Related U.S. Application Data

(60) Provisional application No. 62/843,685, filed on May 6, 2019.

(51) Int. Cl.
*C22C 38/08* (2006.01)
*C21D 1/18* (2006.01)
(Continued)

(52) U.S. Cl.
CPC ..... *C21D 6/007* (2013.01); *C21D 1/18* (2013.01); *C21D 6/004* (2013.01); *C21D 6/005* (2013.01);
(Continued)

(58) Field of Classification Search
CPC ..... C21D 1/18; C21D 6/001; C21D 6/004; C21D 6/005; C21D 6/007; C22C 38/002;
(Continued)

(56) References Cited

U.S. PATENT DOCUMENTS 5,129,966 A 7/1992 Rao
2003/0049153 A1 3/2003 Martin et al.
(Continued)

FOREIGN PATENT DOCUMENTS

CN 103103327 A * 5/2013 ..... C21D 6/02
CN 105177455 A 12/2015

OTHER PUBLICATIONS

W.M. Garrison Jr., J. Met. 42 (1990) 20-24.
(Continued)

*Primary Examiner* — Lois L Zheng
(74) *Attorney, Agent, or Firm* — troutman pepper locke; Tim Tingkang Xia, Esq.

(57) ABSTRACT

An ultra-high strength steel (UHSS) includes a composition designed and processed such that the UHSS has properties comprising a tensile strength of about 2020 MPa, a yield strength of about 1781 MPa and a fracture toughness of about 105 MPa·m$^{1/2}$. The composition incudes Co no more than 8 wt % of the UHSS. The excellent mechanical performance of the UHSS is achieved by nanoscale β-NiAl and $M_2C$ precipitates. The strength and toughness of the UHSS are comparable to those of the commercially used Aermet100 and M54 steels, while the cost of the UHSS is extremely low because of low Ni—Co concentration. This
(Continued)

notable cost advantage makes the novel UHSS very competitive for potentially broad applications as structural components in the field of aerospace.

14 Claims, 8 Drawing Sheets

(51) Int. Cl.

| | |
|---|---|
| ***C21D 6/00*** | (2006.01) |
| ***C21D 6/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |

(52) U.S. Cl.
CPC ..... *C22C 38/002* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C22C 38/52* (2013.01)

(58) Field of Classification Search
CPC ..... C22C 38/02; C22C 38/04; C22C 38/06; C22C 38/08; C22C 38/10; C22C 38/105; C22C 38/44; C22C 38/46; C22C 38/48; C22C 38/52
See application file for complete search history.

(56) References Cited

U.S. PATENT DOCUMENTS

2006/0081309 A1 4/2006 Nasserrafi et al.
2013/0327446 A1* 12/2013 Ueta ..... C22C 38/06 148/328
2016/0376686 A1 12/2016 Jou

OTHER PUBLICATIONS

T. Tomita, Int. Mater. Rev. 45 (2000) 27-37.
R. Tewari, S. Mazumder, I.S. Batra, G.K. Dey, S. Banerjee, Acta Mater. 48 (2000) 1187-1200.
R. Ayer, P. Machmeier, Metall. Mater. Trans. A 29 (1998) 903-905.
R. Ayer, P.M. Machmeier, Metall. Trans. A 24 (1993) 1943-1955.
D.H. Ping, M. Ohnuma, Y. Hirakawa, Y. Kadoya, K. Hono, Mater. Sci. Eng. A 394 (2005) 285-295.
M. Kapoor, D. Isheim, G. Ghosh, S. Vaynman, M.E. Fine, Y.-W. Chung, Acta Mater. 73 (2014) 56-74.
C. Du, S. Jin, Y. Fang, J. Li, S. Hu, T. Yang, Y. Zhang, J. Huang, G. Sha, Y. Wang, Z. Shang, X. Zhang, B. Sun, S. Xin, T. Shen, Nat. Commun. 9 (2018) 5389.
G.R. Speich, D.S. Dabkowski, L.F. Porter, Metall. Trans. 4 (1973) 303-315.
L.X. Huang, X. Hu, C.G. Yang, W. Yan, F.R. Xiao, Y.Y. Shan, K. Yang, J. Nucl. Mater. 443 (2013) 479-483.
A. Mondiere, V. Déneux, N. Binot, D. Delagnes, Mater. Charact. 140 (2018) 103-112.
D. Delagnes, F. Pettinari-Sturmel, M.H. Mathon, R. Danoix, F. Danoix, C. Bellot, P. Lamesle, A. Grellier, Acta Mater. 60 (2012) 5877-5888.
Z.K. Teng, M.K. Miller, G. Ghosh, C.T. Liu, S. Huang, K.F. Russell, M.E. Fine, P.K. Liaw, Scripta Mater. 63 (2010) 61-64.
S.D. Erlach, H. Leitner, M. Bischof, H. Clemens, F. Danoix, D. Lemarchand, I. Siller, Mater. Sci. Eng. A 429 (2006) 96-106.
F. Abe, Sci. Technol. Adv. Mater. 9 (2008) 013002.
V. Gerold, H. Haberkorn, Phys. Stat. Sol. 16 (1966) 675-684.
A.J. Ardell, Metall. Trans. A 16 (1985) 2131-2165.
E. Povoden-Karadeniz, E. Kozeschnik, ISIJ Int. 52 (2012) 610-615.
A. Deschamps, M. Militzer, W.J. Poole, ISIJ Int. 41 (2001) 196-205.
R.R. Bowman, M.V. Nathal, Int. Mater. Rev. 38 (1993) 193-232.
T. Gladman, Mater. Sci. Technol. 15 (1999) 30-36.
S. Jiang, H. Wang, Y. Wu, X. Liu, H. Chen, M. Yao, B. Gault, D. Ponge, D. Raabe, A. Hirata, M. Chen, Y. Wang, Z. Lu, Nature 544 (2017) 460-464.
Z.B. Jiao, J.H. Luan, M.K. Miller, C.Y. Yu, C.T. Liu, Acta Mater. 84 (2015) 283-291.
P.M. Kelly, Int. Metall. Rev. 18 (1973) 31-36.
I. Baker, Mater. Sci. Eng. A 192-193 (1995) 1-13.
J.S. Wang, M.D. Mulholland, G.B. Olson, D.N. Seidman, Acta Mater. 61 (2013) 4939-4952.
D.J. Bacon, U.F. Kocks, R.O. Scattergood, Philos. Mag. 28 (1973) 1241-1263.
M.D. Mulholland, D.N. Seidman, Acta Mater. 59 (2011) 1881-1897.
V. Mohles, Philos. Mag. A 81 (2001) 971-990.
G.B. Olson, Science 277 (1997) 1237-1242.
Korean Intellectual Property Office (ISR/KR), "International Search Report for PCT/US2020/031285", Korea, Aug. 21, 2020.

* cited by examiner

ULTRA-HIGH STRENGTH STEEL AND FORMING METHODS AND APPLICATIONS OF SAME

CROSS-REFERENCE TO RELATED PATENT APPLICATIONS

This application claims priority to and the benefit of U.S. Provisional Application No. 62/843,685, filed May 6, 2019, which is incorporated herein in its entirety by reference.

FIELD OF THE INVENTION

The present invention relates generally to materials, and more particularly to a novel low cost 2000 MPa grade ultra-high strength steel with balanced strength and toughness achieved by nanoscale β-NiAl and $M_2C$ precipitates, methods of making the same, and applications of the same.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as the prior art against the invention.

Because of the good combination of strength, toughness, ductility and fatigue properties, ultra-high strength steels (UHSSs) with tensile strength exceeding 1380 MPa play a critical role in the fields of aerospace, power generation and ship building. Among many different types of UHSSs, the martensitic-based steels, especially those containing parallel arrays or stacks of lath-like structure, are particularly attractive due to its capacity in providing the essential microstructural elements for both high strength and toughness. In addition, as additional secondary phases, strengthening mechanism is usually necessary in the development of UHSSs in order to achieve better overall performance.

Over the past decades, extensive efforts have been focusing on the development of advanced UHSSs in meeting the requirements of reducing energy consumption and carbon dioxide emission in the transport industry. It has been the focus of UHSS researches to search for inexpensive elements that can effectively yield secondary hardening precipitates strengthening. A large family of UHSSs such as maraging steel is mainly hardened by the intermetallic compounds, e.g., $Ni_3$(Ti, Mo). Another large family of UHSSs such as secondary hardening steel is mainly hardened by the $M_2C$ carbides, where M represents the metallic elements Mo and Cr. By embodying all the current strengthening concepts, Aermet100 was developed as a successful one with a unique combination of strength and toughness, the main secondary phase of which is the fine dispersed $M_2C$ carbides. In other aspect, researchers have shown that the body center cubic (BCC) based ferritic/martensitic steels can be significantly hardened by the nano-sized coherent β-NiAl (Pm3m, a=0.2887 nm) particles. Due to a minimal lattice misfit with matrix, β-NiAl can precipitate in great quantity and thus provides sufficient chemical ordering effect to impede the motion of dislocation without generating coherency strains.

The strength-toughness diagram and raw materials cost of several representative/competitive UHSSs are compared in FIGS. 1A and 1B, respectively. Although Aermet100 has excellent mechanical properties, the cost is very high due to the high concentrations expensive alloying elements Co (13.4%) and Ni (11.1%). Since Jan. 1, 2016, the price of cobalt has already increased by 302%, reaching to around 89250 USD/MT. A more severe challenge is that this price is still arising because of the great consumption of Co in the battery materials. Consequently, the excessive price of alloying additions in Aermet100 greatly limits their broad industrial applications.

One well-established disadvantage of reducing Co concentration in Co—Ni family UHSSs, is that it would reduce the $M_2C$ precipitates in the system. Thus, reduction of $M_2C$ precipitates resulted from decreasing Co addition can be compensated by increasing the amount of strong carbide forming elements such as Mo and W. Based on this designing concept, a commercial steel named M54 with comparable properties to Aermet100 but reduced cost has been recently developed. Due to addition of more carbide forming elements (Mo/W), the solution temperature of M54 has increased to 1060° C., which is 175° C. higher than that of Aermet100. Thus, the previous designing concept cannot be used to achieve a more cost reduction steel because continually addition of more Mo and/or W will further increase the solution temperature, which will induce significant grain coarsening. A possible approach is introduce another secondary hardening systems in addition to carbides, but the cost management is still challenging.

Therefore, a heretofore unaddressed need exists in the art to address the aforementioned deficiencies and inadequacies.

SUMMARY OF THE INVENTION

One of the objectives of this invention are to design a low cost martensitic based ultra-high strength steel (UHSS) with a tensile strength of 2020 MPa and fracture toughness of 105 $MPa \cdot m^{1/2}$. The excellent mechanical performance is achieved by nanoscale β-NiAl and $M_2C$ precipitates. The strength and toughness of this novel experimental alloy are comparable to those of the commercially used Aermet100 and M54 steels. However, the cost of the newly designed UHSS is extremely low because of the low Ni—Co concentration.

In one aspect of the invention, the UHSS has a composition designed and processed such that the UHSS has properties comprising a tensile strength of about 2020 MPa, a yield strength of about 1781 MPa and a fracture toughness of about 105 $MPa \cdot m^{1/2}$, wherein the properties are design specifications of the UHSS, the composition comprises Co no more than 8 wt % of the UHSS, and the UHSS is strengthened by duplex precipitates. In one embodiment, the properties further comprise a solution temperature of about 1000° C. and an Ms temperature of about 290° C.

In one embodiment, the composition comprises Ni in a range of about 7.0-10 wt %, Mo in a range of about 1.5-2.5%, Cr in a range of about 0.5-2 wt %, Co in a range of about 3-7 wt %, Al in a range of about 0.8-1.5 wt %, C in a range of about 0.15-0.3 wt %, and Fe in balance.

In one embodiment, the composition further comprises V in a range of about 0-0.3 wt %, Nb in a range of about 0-0.1 wt %, Si≤0.2 wt %, Mn≤0.2 wt %, S≤0.01 wt %, and P≤0.01 wt %.

In one embodiment, the composition nominally comprises 9 wt % Ni, 2 wt % Mo, 1 wt % Cr, 5 wt % Co, 1 wt % Al, 0.25 wt % C, and 81.75 wt % Fe.

In one embodiment, the duplex precipitates comprise nanoscale β-NiAl and $M_2C$ precipitates, wherein M represents the metallic elements Mo and Cr. In one embodiment, strength contributions from the $M_2C$ and β-NiAl precipitates are around 358 MPa and 280 MPa, respectively.

In another aspect of the invention, the UHSS has a composition comprising Ni in a range of about 7.0-10 wt %, Mo in a range of about 1.5-2.5%, Cr in a range of about 0.5-2 wt %, Co in a range of about 3-7 wt %, Al in a range of about 0.8-1.5 wt %, C in a range of about 0.15-0.3 wt %, and Fe in balance.

In one embodiment, the composition further comprises V in a range of about 0-0.3 wt %, Nb in a range of about 0-0.1 wt %, Si≤0.2 wt %, Mn≤0.2 wt %, S≤0.01 wt %, and P≤0.01 wt %.

In one embodiment, the composition nominally comprises 9 wt % Ni, 2 wt % Mo, 1 wt % Cr, 5 wt % Co, 1 wt % Al, 0.25 wt % C, and 81.75 wt % Fe.

In one embodiment, the UHSS is strengthened by duplex precipitates such that the UHSS has a tensile strength of about 2020 MPa, a yield strength of about 1781 MPa and a fracture toughness of about 105 $MPa \cdot m^{1/2}$. In another embodiment, the UHSS further has a solution temperature of about 1000° C. and an Ms temperature of about 290° C.

In one embodiment, the duplex precipitates comprise nanoscale β-NiAl and $M_2C$ precipitates, wherein M represents the metallic elements Mo and Cr. In one embodiment, strength contributions from the $M_2C$ and β-NiAl precipitates are around 358 MPa and 280 MPa, respectively.

In yet another aspect of the invention, the method for fabricating an UHSS includes providing a composition designed according to design specifications of the UHSS; melting the composition and forging the melted composition to form an ingot; solution-treating the forged ingot at a first temperature for a first period of time and quenching the treated ingot to room temperature; immersing the quenched ingot in liquid $N_2$ and heating immersed ingot in air to room temperature; and subjecting the heated ingot to a tempering treatment at a second temperature for a second period of time, to obtain the UHSS having properties that are the design specifications.

In one embodiment, the first temperature is in a range of about 800-1200° C., and the first period of time is in a range about 0.5-1.5 h. In one embodiment, the first temperature is about 1000° C., and the first period of time is about 1 h. In one embodiment, the second temperature is in a range of about 335-735° C., and the second period of time is in a range about 2-6 h. In one embodiment, the second temperature is about 535° C. and the second period of time is about 4 h.

In one embodiment, the composition comprises Ni in a range of about 7.0-10 wt %, Mo in a range of about 1.5-2.5%, Cr in a range of about 0.5-2 wt %, Co in a range of about 3-7 wt %, Al in a range of about 0.8-1.5 wt %, C in a range of about 0.15-0.3 wt %, and Fe in balance.

In one embodiment, the composition further comprises V in a range of about 0-0.3 wt %, Nb in a range of about 0-0.1 wt %, Si≤0.2 wt %, Mn≤0.2 wt %, S≤0.01 wt %, and P≤0.01 wt %.

In one embodiment, the composition nominally comprises 9 wt % Ni, 2 wt % Mo, 1 wt % Cr, 5 wt % Co, 1 wt % Al, 0.25 wt % C, and 81.75 wt % Fe.

In one embodiment, the properties comprises a tensile strength of about 2020 MPa, a yield strength of about 1781 MPa, a fracture toughness of about 105 $MPa \cdot m^{1/2}$, a solution temperature of about 1000° C. and an Ms temperature of about 290° C.

These and other aspects of the present invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1A:
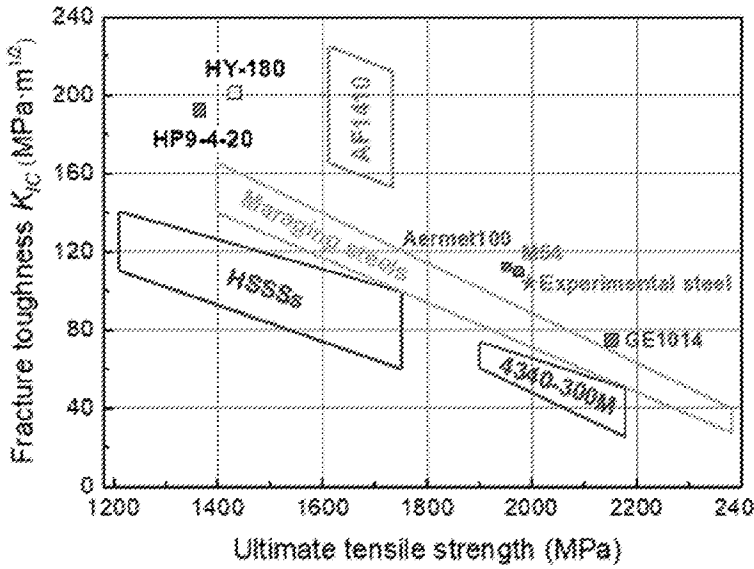
FIG. 1A shows toughness-tensile strength diagram for several representative high strength steels used in aeronautical applications and a low cost martensitic based ultra-high strength steel (UHSS) according to embodiments of the invention. HSSSs is abbreviated for high strength stainless steels.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that, as used in the description herein and throughout the claims that follow, the meaning of "a", "an", and "the" includes plural reference unless the context clearly dictates otherwise. Also, it will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprises" and/or "comprising," or "includes" and/or "including" or "has" and/or "having", or "carry" and/or "carrying," or "contain" and/or "containing," or "involve" and/or "involving, and the like are to be open-ended, i.e., to mean including but not limited to. When used in this disclosure, they specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

Aermet100 and M54 steels are widely used as structural components in the field of aerospace. However, the raw material cost of Aermet100 is very high because of high concentration of Co (13.4%) and Ni (11.1%). M54 steel developed by increasing Mo, C and additionally introduction of W is also very expensive. Both Aermet100 and M54 steels are the same type of UHSSs, which are hardened by $M_2C$ carbides.

One of the objectives of this invention are to design a low cost martensitic based ultra-high strength steel with a tensile strength of 2020 MPa and fracture toughness of 105 MPa in$^2$ The excellent mechanical performance is achieved by nanoscale β-NiAl and $M_2C$ precipitates. The strength and toughness of the novel steel according to embodiments of the invention are comparable to those of the commercially used Aermet100 and M54 steels. However, the cost of the novel steel is extremely low because of the low Ni—Co concentration.

Figure 1B:
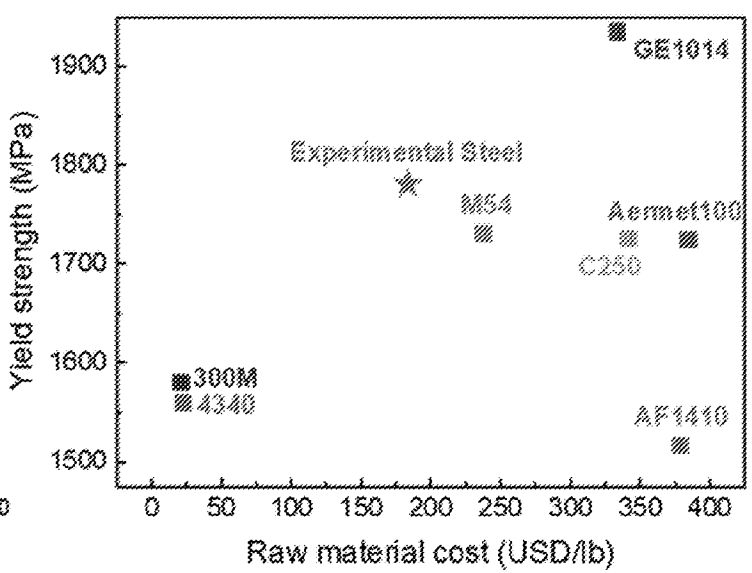
FIG. 1B shows yield strength v.s. raw material cost diagram for several competitive UHSSs and the low cost martensitic based UHSS according to embodiments of the invention.

In certain embodiments, the composition space of the UHSSs strengthened by duplex secondary phases is optimized and a novel 2000 MPa grade UHSS with only 5% Co and the toughness of 105 MPa·m$^{1/2}$ is designed. Among other things, the main approach is to increase Al concentration, which can compensate the loss of strength due to the reduction of carbides formation with low Co concentration by forming additional β-NiAl. In other words, by means of duplex precipitates ($M_2C$ carbide and β-NiAl) strengthening, the novel low Co—Ni secondary hardening martensite based ultra-high strength steel is achieved. The ultimate tensile strength, yield strength and fracture toughness of this newly designed, as-aged UHSS is 2020 MPa, 1781 MPa and 105 MPa·m$^{1/2}$, respectively. As shown in FIG. 1A, the newly designed UHSS (i.e., "Experimental steel" denoted in FIGS. 1A-1B) exhibits a comparable ratio of toughness to the tensile strength to those of Aermet100 and M54. Because of the great reduction of Co, the raw material cost of the newly designed steel is 52.2% less than that of Aermet100 and 45% less than that of GE1014 and 22.7% less than that of M54. That is, the raw materials cost of the novel UHSS in some embodiments is only about 47.8% of Aermet100 and about 77.3% of M54.

In one aspect of the invention, the UHSS has a composition designed and processed such that the UHSS has properties comprising a tensile strength of about 2020 MPa, a yield strength of about 1781 MPa and a fracture toughness of about 105 MPa·m$^{1/2}$. The properties are design specifications of the UHSS. In some embodiments, the properties further comprise a solution temperature of about 1000° C. and an Ms temperature of about 290° C.

The composition comprises Co no more than 8 wt % of the UHSS, and the UHSS is strengthened by the duplex precipitates. Precipitation strengthening is a heat treatment process to produce precipitates within a metal's grain structure that help hinder motion, thereby strengthening the UHSS. In some embodiments, the duplex precipitates comprise nanoscale β-NiAl and $M_2C$ precipitates, where M represents the metallic elements Mo and Cr. In certain embodiments, strength contributions from the $M_2C$ and β-NiAl precipitates are around 358 MPa and 280 MPa, respectively.

In certain embodiments, the composition comprises Ni in a range of about 7.0-10 wt %, Mo in a range of about 1.5-2.5%, Cr in a range of about 0.5-2 wt %, Co in a range of about 3-7 wt %, Al in a range of about 0.8-1.5 wt %, C in a range of about 0.15-0.3 wt %, and Fe in balance.

In certain embodiments, the composition further comprises V in a range of about 0-0.3 wt %, Nb in a range of about 0-0.1 wt %, Si≤0.2 wt %, Mn≤0.2 wt %, S≤0.01 wt %, and P≤0.01 wt %.

In certain embodiments, the composition nominally comprises 9 wt % Ni, 2 wt % Mo, 1 wt % Cr, 5 wt % Co, 1 wt % Al, 0.25 wt % C, and 81.75 wt % Fe.

In another aspect of the invention, the method for fabricating an UHSS includes providing a composition designed according to design specifications of the UHSS; melting the composition and forging the melted composition to form an ingot; solution-treating the forged ingot at a first temperature for a first period of time and oil quenching the treated ingot to room temperature; immersing the quenched ingot in liquid $N_2$ and heating immersed ingot in air to room temperature; and subjecting the heated ingot to a tempering treatment at a second temperature for a second period of time, to obtain the UHSS having properties that are the design specifications. In one embodiment, the first temperature is in a range of about 800-1200° C., and the first period of time is in a range about 0.5-1.5 h. In one embodiment, the first temperature is about 1000° C., and the first period of time is about 1 h. In one embodiment, the second temperature is in a range of about 335-735° C., and the second period of time is in a range about 2-6 h. In one embodiment, the second temperature is about 535° C. and the second period of time is about 4 h.

In certain embodiments, the composition is disclosed as above. As such, the fabricated UHSS has the properties comprising a tensile strength of about 2020 MPa, a yield strength of about 1781 MPa, a fracture toughness of about 105 MPa·m$^{1/2}$, a solution temperature of about 1000° C. and an Ms temperature of about 290° C.

According to the invention, the newly designed UHSS has the balanced high strength and toughness that is very comparable to those of the commercially used Aermet100 and M54, while the raw materials cost of the novel steel is only about 47.8% of Aermet100 and about 77.3% of M54. The newly designed UHSS will be a good candidate for aerospace applications which is now dominated by Aermet100 and M54.

These and other aspects of the present invention are further described below. Without intent to limit the scope of the invention, exemplary instruments, apparatus, methods and their related results according to the embodiments of the present invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

Examples of Ultra-High Strength Steels

The following non-limiting examples aim, among other things, to gain better understanding of the strengthening mechanisms of this novel alloys through detailed microstructural observations.

In this exemplary example, the ultra-high strength steel/alloy is fabricated from a composition including about 81.75% Fe, about 9% Ni, about 5% Co, about 2% Mo, about 1% Cr, about 1% Al and about 0.25% C in weight, which is designated as AIR0509. Specifically, the ultra-high strength steel/alloy was produced by vacuum induction melting of the composition with size of about (P250 mm, followed by forging into the size of about (P90 mm. The forged ingots were solution-treated at about 1000° C. for about 1 h and then oil quenched to room temperature. After quenching, the alloy was immersed in liquid $N_2$ for about 1 h and then heated in air to room temperature. Consequently, the quenched alloy was subjected to the tempering treatment at about 535° C. for about 4 h. The as-quenched and as-aged conditions are designated AQ and AA, respectively. Room temperature tensile test was conducted on specimens with a diameter of about 5 mm at a strain rate of about $10^{-3}$ $s^{-1}$. Charpy V-notch (CVN) impact toughness tests were carried out on specimens with dimensions of about 10×10×55 mm. Fracture toughness ($K_{IC}$) test was carried out on specimens with a size of about 10×20×140 mm. Optical microscopy (OM) was performed using Leica EC3. Secondary electron image was obtained using Sirion 200 scanning electron microscope (SEM). Transmission electron microscopy (TEM) experiments were carried out on ARM 200 CF, which was equipped with a probe corrector and dual silicon drift detector (SDD). Pulsed-laser atom-probe tomography (APT) was performed on the AA sample (i.e., one embodiment of the invented steel subjected to the as-aged condition) using a LEAP CAMECA LEAP 5000XS tomography at about 30 K.

Figure 2A:
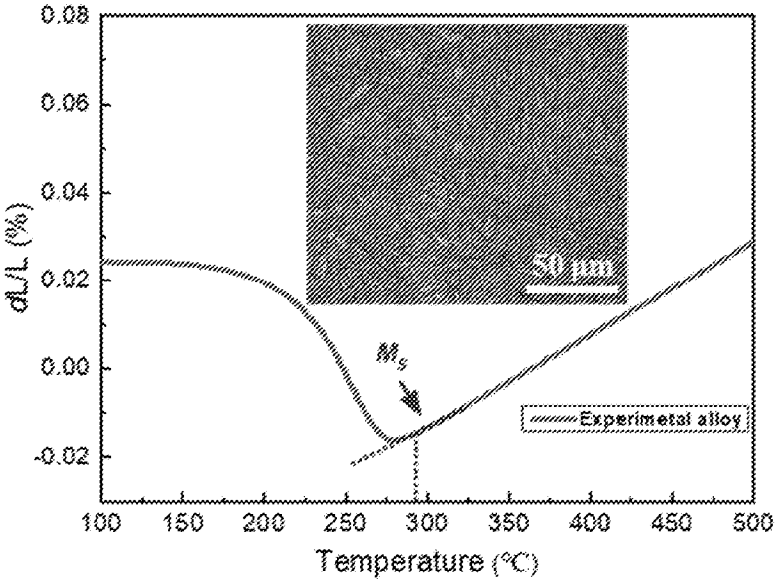
FIG. 2A shows a thermal expansion curve of the steel according to embodiments of the invention. The Ms point is determined as 290° C. Inset is the optical microscopy (OM) of the as-quenched (AQ) steel.
Figure 2B:
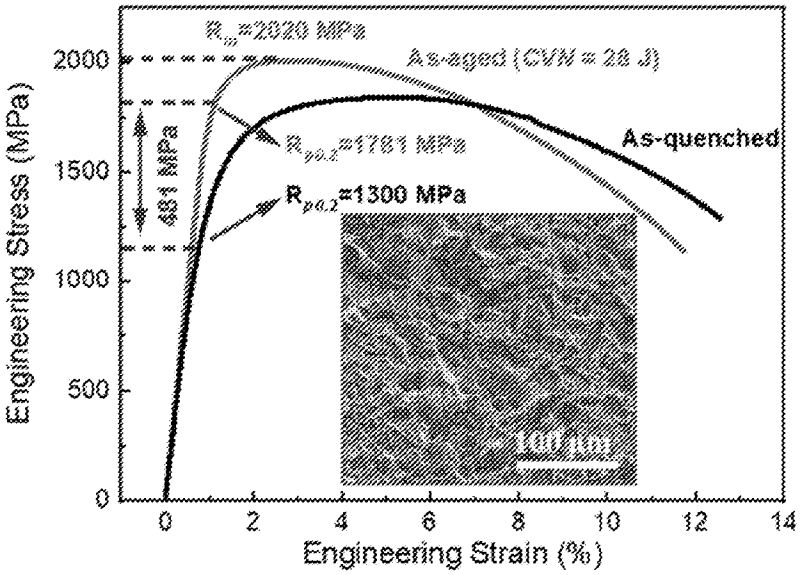
FIG. 2B shows room-temperature tensile stress-strain curves of the AQ and as-aged (AA) steels according to embodiments of the invention. The increment in yield stress of the steel with AQ and AA conditions is 481 MPa. Inset is a secondary electron image of the room-temperature fracture surface of impact AA samples. The AA sample(s) used herein refers to one embodiment of the UHSS of the invention. The corresponding room-temperature Charpy V-notch (CVN) is 27 J.

Based on the thermal expansion curve of the exemplary steel shown in FIG. 2A, the Ms point can be determined as about 290° C., which is much higher than that of Aermet100 (225° C.) and M54 (204° C.). Thus, this exemplary steel does not require more rigorous cooling conditions to finalize the martensite phase transformation. The micrograph of inset in FIG. 2A imaged by secondary electrons shows the typical martensite laths within the AQ sample (i.e., the one embodiment of the invented steel subjected to the as-quenched condition), where none of primary carbides can be identified. Thus, the used solution temperature about 1000° C., which is about 115° C. higher than that of Aermet100 but still about 60° C. lower than that of M54, is sufficient for the steel according to the invention. Therefore, there is no significant grain growth. The room temperature tensile stress-strain curves for both the AQ and AA samples are shown in FIG. 2B. The yield strength ($\sigma_{YS}$) of the AA condition is about 1780 MPa, together with an ultimate tensile strength ($\sigma_{UTS}$) of about 2020 MPa and a total elongation of about 13.0% with about 65% section shrinkage. In contrast to the AQ sample, the AA steel shows a strong aging response in the yield strength with about 37% increment (about 481 MPa). Meanwhile, the AA samples show high toughness with the CVN of about 28 J and $K_{IC}$ value of about 105 $MPa \cdot m^{1/2}$. Fractography of the AA sample of inset in FIG. 2B shows the deep dimples and high density of tearing ridges, demonstrating this high toughness.

Figure 3A:
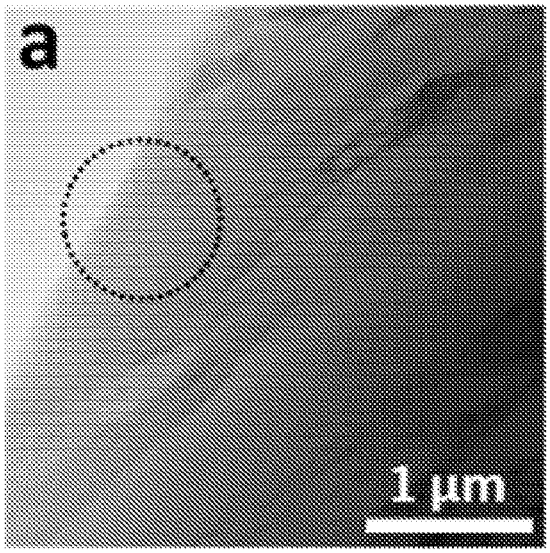
FIGS. 3A-3B show respectively low and high magnification bright field scanning TEM (BF-STEM) image showing the general microstructural features of the AA sample according to embodiments of the invention.
Figure 3B:
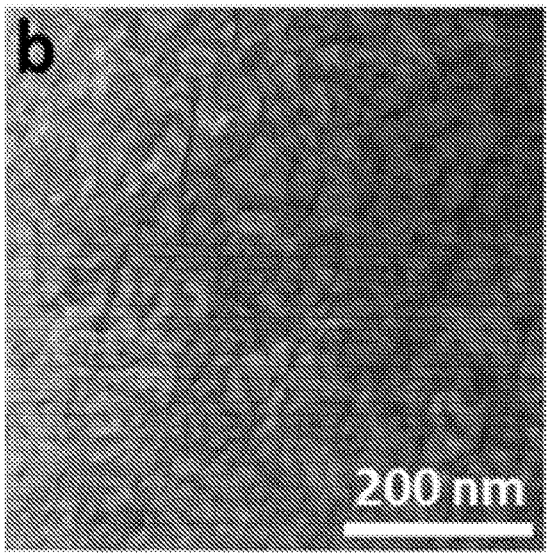
Figure 3C:
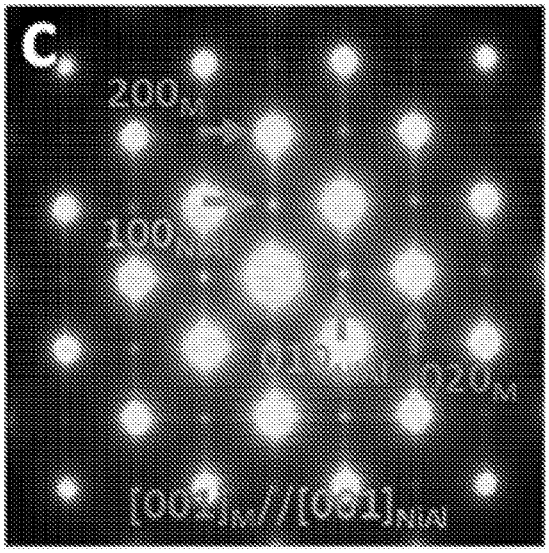
FIG. 3C shows EDPs of the AA sample along $[001]_M$ direction obtained from the circled region indicated in FIG. 3A.
Figures 3D, 3E, 3F:
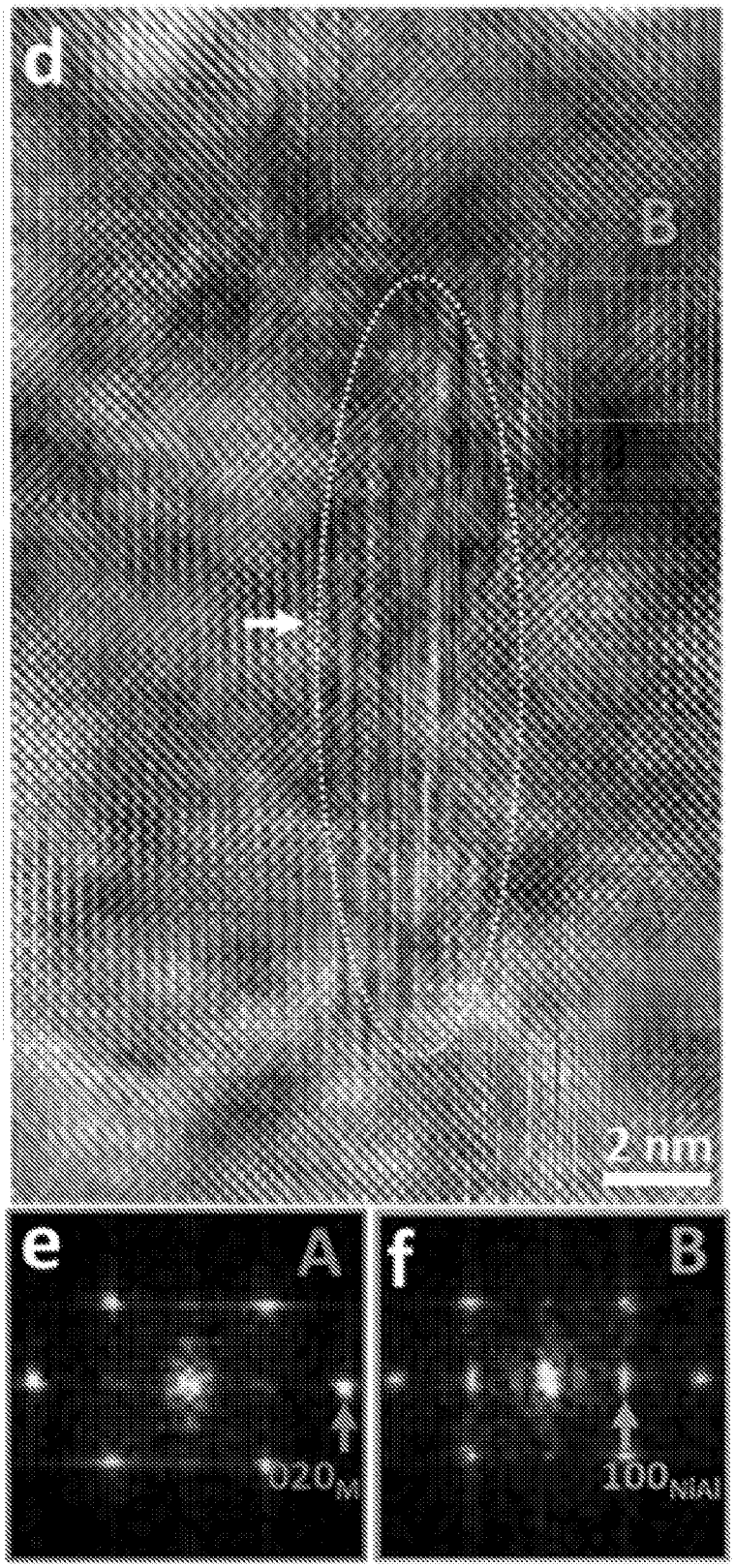
FIG. 3D shows a high resolution (HRTEM) image of the AA sample along $[001]_M$ direction.
FIGS. 3E-3F show fast Fourier transform (FFT) patterns corresponded to region A and B indicated in FIG. 3D.
Figure 3G:
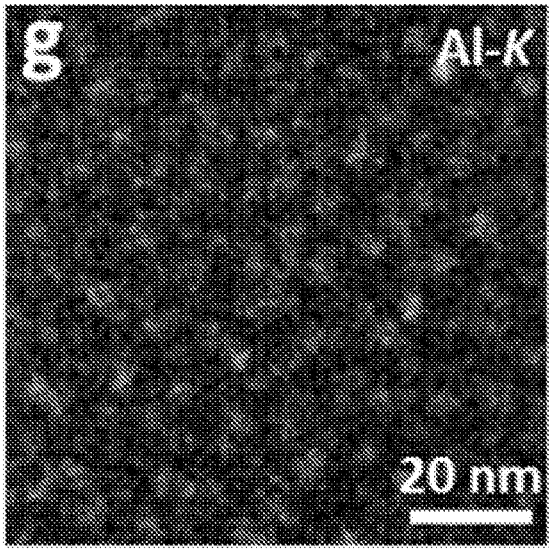
FIGS. 3G-3L show element maps corresponding to Al—K, Cr—K, Mo-L, Ni—K, Fe—K and Co—K, respectively.
Figure 3H:
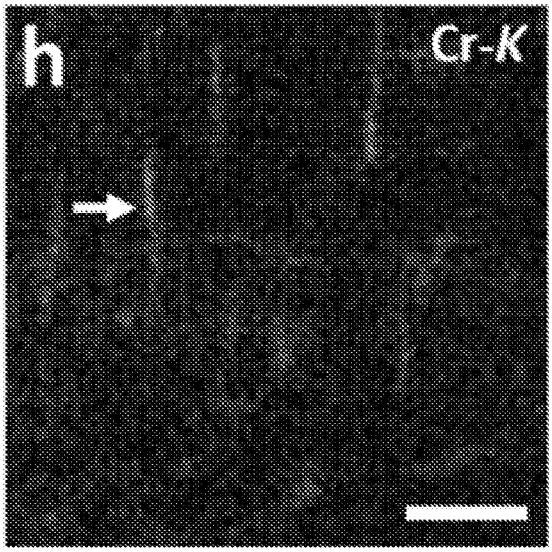
Figure 3I:
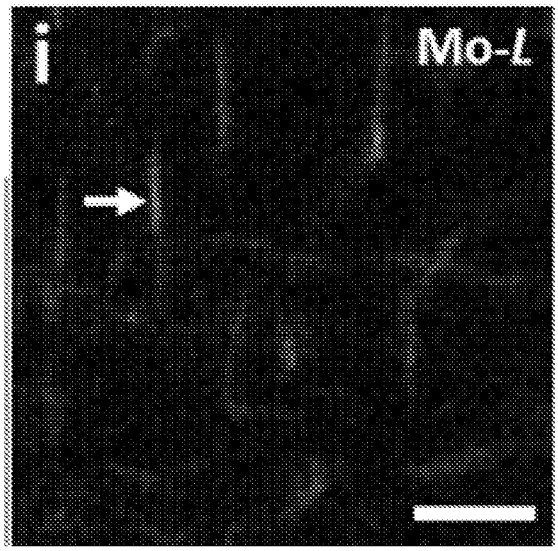
Figure 3J:
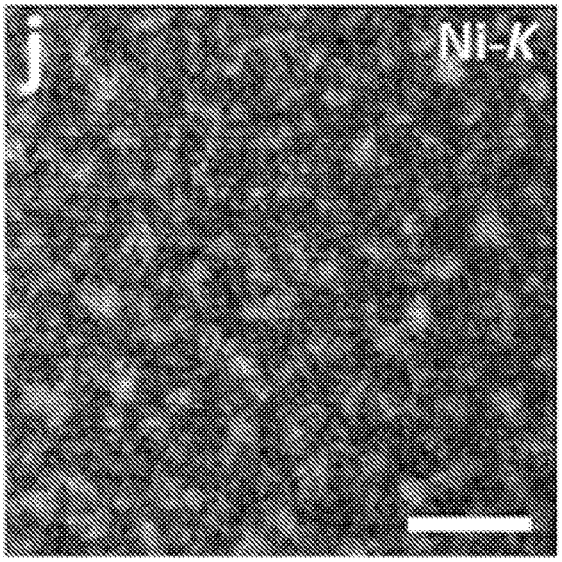
Figure 3K:
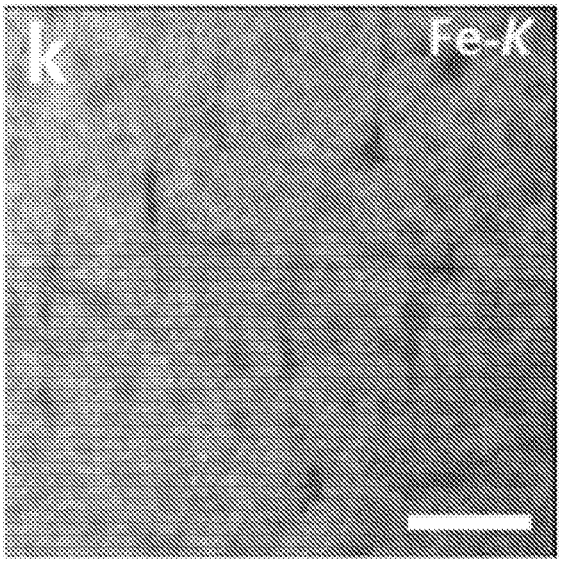
Figure 3L:
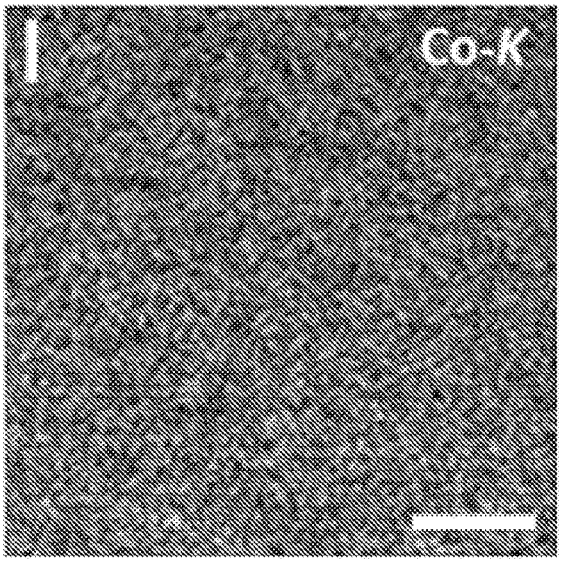

As shown in bright filed (BF) image of FIG. 3A, the width of martensite laths ranged from about 50 nm to about 2 m. High magnification BF image in FIG. 3B shows that there are many needle shaped precipitates. The width of these precipitates is less than about 2 nm. The long axis is however in tens of nanometer. The corresponding electron diffraction patterns (EDPs) are shown in FIG. 3C. The strong reflections correspond to the martensite matrix, while the weak patterns between main reflections can be indexed as β-NiAl. This β-NiAl keeps cube-on-cube relationship with the martensite matrix. Additionally, there are strong striking features along {100}* direction, which is resulted from the nanosized needle shaped precipitates. High resolution TEM (HRTEM) image shown in FIG. 3D corresponding FFT patterns (FIGS. 3E-3F) demonstrates that the nano-sized β-NiAl precipitates have full coherency with the matrix with a lattice misfit strain less than about 1%. Furthermore, based on the HRTEM image shown in FIG. 3D, this needle shaped precipitates does not have a good coherency with the matrix. By means of energy dispersive spectrum (EDS) mapping, the general precipitated feature of this AA sample is further revealed. As shown in element maps of FIGS. 3G-3L, the β-NiAl precipitates have a globular morphology with a diameter of about 3 nm. The needle shaped precipitates are mainly rich in Mo and Cr, which correspond to the $(Mo, Cr)_2C$ carbides.

Figure 4A:
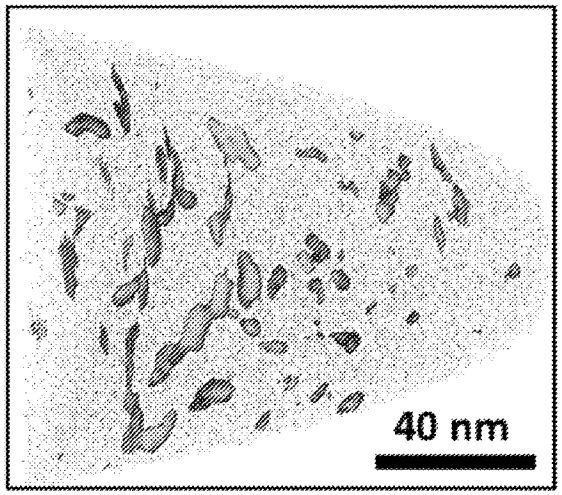
FIG. 4A shows $M_2C$ carbides highlighted by an isoconcentration surface encompassing regions containing more than 25 at % of Mo and C combined in an atom probe tomography (APT) reconstruction of the AA sample.
Figure 4B:
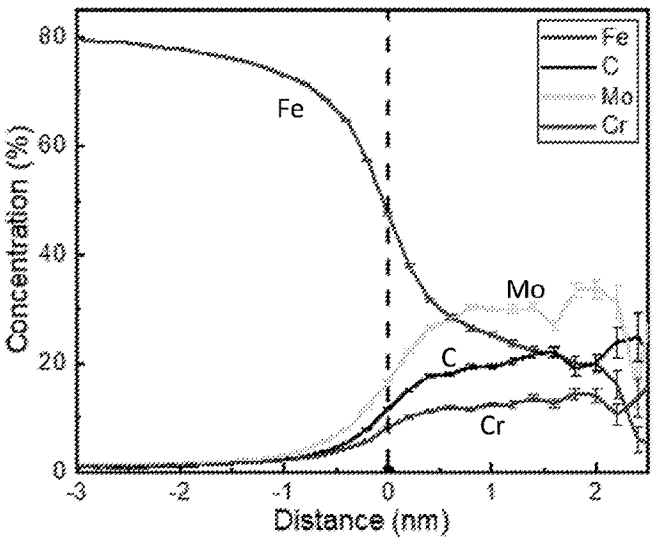
FIGS. 4B-4C show proximity histograms showing the composition changes across the $M_2C$ carbides.
Figure 4C:
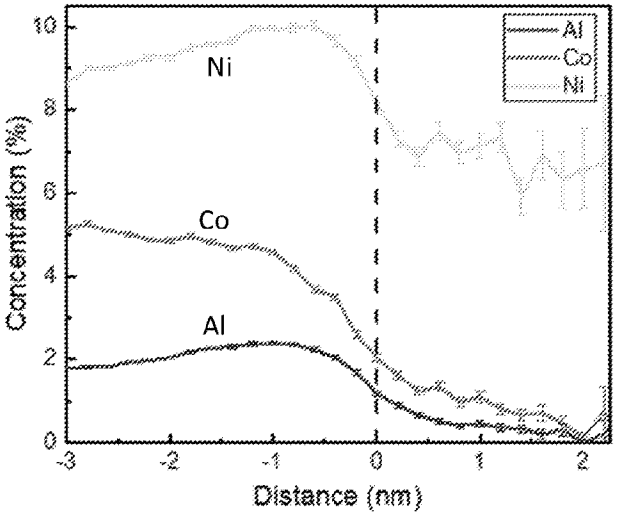
Figure 4D:
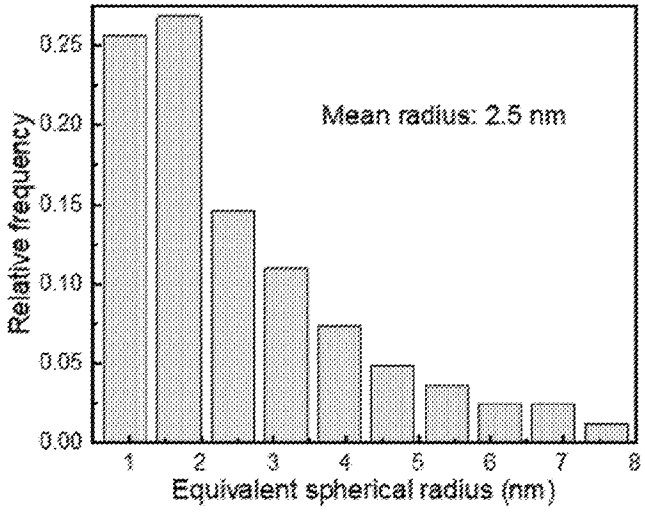
FIG. 4D shows a radius distribution of $M_2C$ carbides.
Figure 4E:
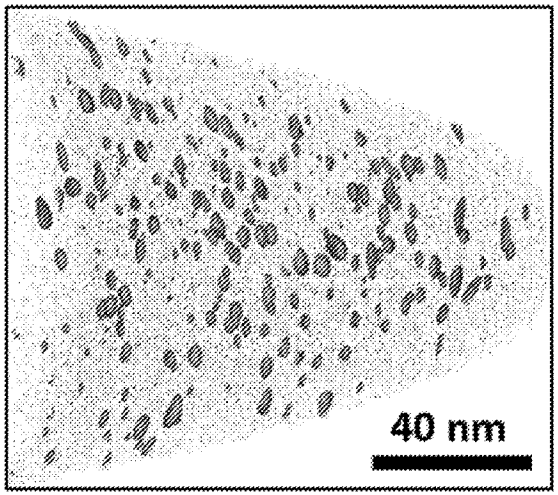
FIG. 4E shows β-NiAl precipitates highlighted by an isoconcentration surface encompassing regions containing more than 40 at % of Ni and Al combined in an APT reconstruction of the AA sample.
Figure 4F:
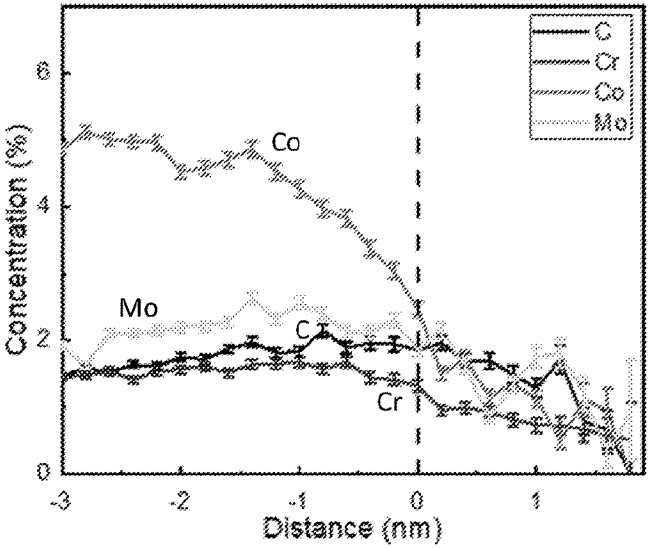
FIGS. 4F-4G show proximity histograms showing the composition changes across β-NiAl precipitates.
Figure 4G:
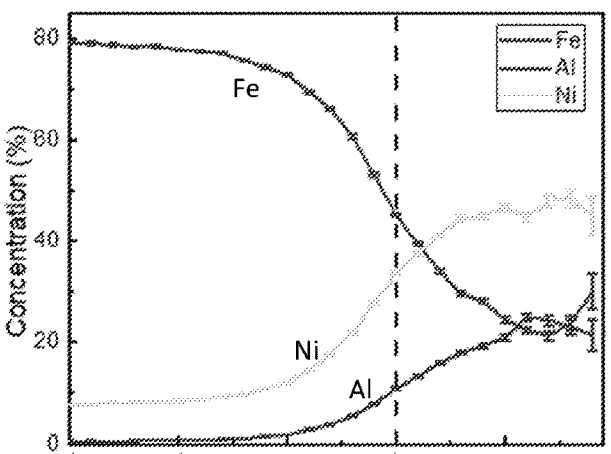
Figure 4H:
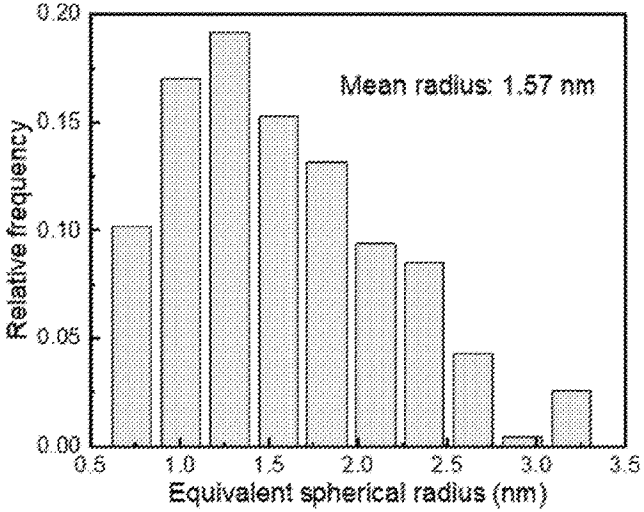
FIG. 4H shows a radius distribution of β-NiAl precipitates.

To gain further insight into the quantitative composition and volume fraction of these precipitates, APT conducted on the AA sample is shown in FIGS. 4A-4H. The precipitates highlighted by an isoconcentration surface encompassing regions contain more than about 25 at. % of Mo and C combined and about 40 at. % of Ni and Al combined are shown in FIGS. 4A and 4E, respectively. The proximity histogram derived from the 10 largest precipitates for two different kinds of secondary phases are shown in FIGS. 4B-4C and 4F-4G, respectively. The carbide phase follows the results of similar steels, M54, Ametet100, showing a composition of $M_2C$. The average compositions of martensite matrix, $M_2C$ and β precipitates are listed in Table 1, together with the nominal composition. Please note that the nominal composition listed in in atomic percentages in Table 1 are the same as the composition of 9 wt % Ni, 2 wt % Mo, 1 wt % Cr, 5 wt % Co, 1 wt % Al, 0.25 wt % C, and 81.75 wt % Fe in weight percentages. The composition of the bulk alloys is changed from wt % to at % in Table 1 in order to compare with the APT analyses of other phases. The major alloying elements, i.e., Ni and Co, show a similar level between matrix and the nominal composition, with Ni slightly lower and Co slightly higher in matrix. The concentration of Mo in matrix is in a similar level compared with that of other high Co steels. This indicates that reduction of Co in this newly designed steel does not result in significant Co solution in matrix. Additionally, it is seen that these precipitates are far from their stoichiometric compositions, indicating that these secondary phases under such conditions should be regarded as a transient state. Precipitate size distributions (PSD) of $M_2C$ and β precipitates are shown in FIGS. 4D and 4H, respectively. The equivalent mean radius of these carbides was about 2.5 nm with a number density of $8.6 \times 10^{22}$ $m^{-3}$. NiAl precipitate was about 1.5 nm with a number density of $3.21 \times 10^{23}$ $m^{-3}$.

TABLE 1

Chemical composition (at. %) of β precipitates and $M_2C$ carbides in the as-aged sample.

| Phase | Fe | Ni | Mo | Cr | Co | Al | C |
|---|---|---|---|---|---|---|---|
| Nominal | 81.33 | 8.52 | 1.16 | 1.07 | 4.71 | 2.06 | 1.15 |
| Matrix | 82.49 | 8.40 | 0.64 | 0.86 | 4.79 | 1.97 | 0.85 |
| β | 33.74 | 35.46 | 1.53 | 1.35 | 1.50 | 24.17 | 2.25 |
| $M_2C$ | 19.21 | 6.65 | 34.99 | 15.07 | 0.73 | 0.39 | 22.96 |

Hardening mechanisms contributed to yield strength at room temperature involve dislocation strengthening, solid solution strengthening, sub-boundary strengthening and precipitation strengthening. However, in the steel according to embodiments of the invention, precipitation hardening is a crucial factor that increase the yield strength remarkably (481 MPa) after 4 h aging. Consequently, the strength contribution was estimated from each phases. As the mean particle radius of β precipitates is about 1.4 nm, which is smaller than the critical radius (several nanometers), these coherent β precipitates are believed to strengthen the matrix via dislocation shearing involving the coherency strengthening ($\Delta\sigma_{coherency}$), ordering strengthening ($\Delta\sigma_{ordering}$) and modulus mismatch strengthening ($\Delta\sigma_{modulus}$). The coherency strengthening is resulted from the interaction of the stress field associated with the misfit strain between coherent particles and the stress field of dislocations. It can be described as $$\Delta\sigma_{coherency} = M\chi(\varepsilon G)^{\frac{3}{2}}\left(\frac{rfb}{\Gamma}\right)^{\frac{1}{2}}. \quad (1)$$

M equaling 2.9 is the Taylor factor of BCC metals in tension. χ is a constant parameter equaling 2.6. ε equaling $$\left|\frac{a_p - a_m}{a_m}\right|\left[\frac{1+2G(1-2v_p)}{G_p(1+v_p)}\right]$$

is the lattice mismatch parameter, where $G_p$ (88 GPa) and $v_p$ (0.31) are share modulus and Poisson's ratio of the β-NiAl precipitate. $G_p$ is the shear modulus of matrix equaling 77 GPa. r is the mean radius of the β precipitates. f is the volume fraction of β precipitates equaling $$\left(\frac{4}{3}\right)\pi n r^3,$$

where n is the number density of the precipitates. b (about 0.25 nm) is the magnitude of the Burgers vector of the matrix. Γ is the dislocation line tension approximately equaling $Gb^2/2$. Therefore, the coherency strengthening ($\Delta\sigma_{coherency}$) is calculated as about 22 MPa. The ordering strengthening effect is resulted from the formation of anti-phase energy (APB) when dislocation cut the ordered precipitates. The stress increment can be estimated by $$\Delta\sigma_{order} = M\left(\frac{\gamma^{3/2}}{b}\right)\left(\frac{4r_s f}{\pi\Gamma}\right)^{1/2} \quad (2)$$

γ equaling 0.5 $J\cdot m^{-2}$ is the average value of the APB for B2 structure. $\gamma_s$ equaling $(2/3)^{1/2}r$ is the average radius of the precipitates in gliding plane. The other parameters here are the same as the ones in Equation (1). Thereby, the ordering strengthening ($\Delta\sigma_{ordering}$) is calculated as about 226 MPa. Due to the difference of shear modulus between the matrix and precipitates, modulus strengthening arises when a dislocation moves from the matrix into β phases. Here, the Knowles-Kelly equation is used to evaluate this effect as $$\Delta\sigma_{modulus} = \frac{M\Delta G}{4\pi^2}\frac{3\Delta G^{1/2}}{Gb}\left[0.8 - 0.143\ \ln\left(\frac{r}{b}\right)\right]^{2/3} r^{1/2} f^{1/2} \quad (3)$$

Parameter ΔG is the difference in the shear modulus between matrix and the precipitates; the shear modulus of B2 phase is 88 GPa; others are the same as described in Equation (1). The modulus mismatch strengthening ($\Delta\sigma_{modulus}$) is calculated as about 34 MPa. Thus, the total strength contribution from β precipitates is around 280 MPa. Similarly, according to previous work, Orowan bypass mechanism is the main operating strengthening mechanism for $M_2C$ carbides and the yield strength increment can be calculated as about 358 MPa, which is 78 MPa than that of β-NiAl precipitates. The total strength contribution from β-NiAl and $M_2C$ precipitates around 638 MPa, which is higher than the strength increment (481 MPa) due to aging. This resulted from the decrement of the solution strengthening and deformation hardening in the AA sample due to depleting of the C concentration and recovering of dislocations in martensite matrix.

Briefly, according to the invention, by means of duplex precipitates ($M_2C$ carbide and β-NiAl) strengthening, a novel low Co—Ni secondary hardening martensite based ultra-high-strength steel with the solution temperature of about 1000° C. and Ms point of about 290° C. is developed. The ultimate tensile strength, yield strength and fracture toughness of this as-aged experimental steel is about 2020 MPa, about 1781 MPa and about 105 $MPa\cdot m^{1/2}$, respectively. The strength contribution from $M_2C$ carbide and β-NiAl intermetallic compound are around 358 MPa and 280 MPa, respectively. The balanced high strength and toughness of the novel steel is very comparable to those of the commercially used Aermet100 and M54. However, the raw materials cost of this novel steel is only about 47.8% of Aermet100 and about 77.3% of M54. This obvious low cost feature make this experimental steel very competitive, which is a good candidate for aerospace applications including landing gear, engine shafts and drive shafts.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

Some references, which may include patents, patent applications and various publications, are cited and discussed in the description of this invention. The citation and/or discussion of such references is provided merely to clarify the description of the present invention and is not an admission that any such reference is "prior art" to the invention described herein. All references cited and discussed in this specification are incorporated herein by reference in their entireties and to the same extent as if each reference was individually incorporated by reference.

LIST OF REFERENCES

[1] W. M. Garrison Jr., J. Met. 42 (1990) 20-24.
[2] T. Tomita, Int. Mater. Rev. 45 (2000) 27-37.
[3] R. Tewari, S. Mazumder, I. S. Batra, G. K. Dey, S. Banerjee, Acta Mater. 48 (2000) 1187-1200.
[4] R. Ayer, P. Machmeier, Metall. Mater. Trans. A 29 (1998) 903-905.

[5] R. Ayer, P. M. Machmeier, Metall. Trans. A 24 (1993) 1943-1955.
[6] D. H. Ping, M. Ohnuma, Y. Hirakawa, Y. Kadoya, K. Hono, Mater. Sci. Eng. A 394 (2005) 285-295.
[7] M. Kapoor, D. Isheim, G. Ghosh, S. Vaynman, M. E. Fine, Y.-W. Chung, Acta Mater. 73 (2014) 56-74.
[8] C. Du, S. Jin, Y. Fang, J. Li, S. Hu, T. Yang, Y. Zhang, J. Huang, G. Sha, Y. Wang, Z. Shang, X. Zhang, B. Sun, S. Xin, T. Shen, Nat. Commun. 9 (2018) 5389.
[9] G. R. Speich, D. S. Dabkowski, L. F. Porter, Metall. Trans. 4 (1973) 303-315.
[10] L. X. Huang, X. Hu, C. G. Yang, W. Yan, F. R. Xiao, Y. Y. Shan, K. Yang, J. Nucl. Mater. 443 (2013) 479-483.
[11] A. Mondiere, V. Déneux, N. Binot, D. Delagnes, Mater. Charact. 140 (2018) 103-112.
[12] D. Delagnes, F. Pettinari-Sturmel, M. H. Mathon, R. Danoix, F. Danoix, C. Bellot, P. Lamesle, A. Grellier, Acta Mater. 60 (2012) 5877-5888.
[13] Z. K. Teng, M. K. Miller, G. Ghosh, C. T. Liu, S. Huang, K. F. Russell, M. E. Fine, P. K. Liaw, Scripta Mater. 63 (2010) 61-64.
[14] S. D. Erlach, H. Leitner, M. Bischof, H. Clemens, F. Danoix, D. Lemarchand, I. Siller, Mater. Sci. Eng. A 429 (2006) 96-106.
[15] F. Abe, Sci. Technol. Adv. Mater. 9 (2008) 013002.
[16] V. Gerold, H. Haberkorn, Phys. Stat. Sol. 16 (1966) 675-684.
[17] A. J. Ardell, Metall. Trans. A 16 (1985) 2131-2165.
[18] E. Povoden-Karadeniz, E. Kozeschnik, ISIJ Int. 52 (2012) 610-615.
[19] A. Deschamps, M. Militzer, W. J. Poole, ISIJ Int. 41 (2001) 196-205.
[20] R. R. Bowman, M. V. Nathal, Int. Mater. Rev. 38 (1993) 193-232.
[21] T. Gladman, Mater. Sci. Technol. 15 (1999) 30-36.
[22] S. Jiang, H. Wang, Y. Wu, X. Liu, H. Chen, M. Yao, B. Gault, D. Ponge, D. Raabe, A. Hirata, M. Chen, Y. Wang, Z. Lu, Nature 544 (2017) 460-464.
[23] Z. B. Jiao, J. H. Luan, M. K. Miller, C. Y. Yu, C. T. Liu, Acta Mater. 84 (2015) 283-291.
[24] P. M. Kelly, Int. Metall. Rev. 18 (1973) 31-36.
[25] I. Baker, Mater. Sci. Eng. A 192-193 (1995) 1-13.
[26] J. S. Wang, M. D. Mulholland, G. B. Olson, D. N. Seidman, Acta Mater. 61 (2013) 4939-4952.
[27] D. J. Bacon, U. F. Kocks, R. O. Scattergood, Philos. Mag. 28 (1973) 1241-1263.
[28] M. D. Mulholland, D. N. Seidman, Acta Mater. 59 (2011) 1881-1897.
[29] V. Mohles, Philos. Mag. A 81 (2001) 971-990.
[30] G. B. Olson, Science 277 (1997) 1237-1242.

What is claimed is:

1. An ultra-high strength steel (UHSS), comprising:

a composition designed and processed such that the UHSS has properties comprising a tensile strength of about 2020 MPa, a yield strength of about 1781 MPa and a fracture toughness of about 105 MPa·$m^{1/2}$, wherein the properties are design specifications of the UHSS, the composition comprises Co no more than 8 wt %, Al in a range of about 0.8-1.5 wt %, Ni in a range of about 7.0-10 wt %, Mo in a range of about 1.5-2.5%, Cr in a range of about 0.5-2 wt %, C in a range of about 0.15-0.3 wt %, and Fe in balance, and the UHSS is strengthened by duplex precipitates, wherein the duplex precipitates comprise nanoscale β-NiAl and $M_2C$ precipitates, wherein M represents the metallic elements Mo and Cr; and wherein strength contributions from the $M_2C$ and β-NiAl precipitates are around 358 MPa and 280 MPa, respectively.

2. The UHSS of claim 1, wherein the composition further comprises V in a range of about 0-0.3 wt %, Nb in a range of about 0-0.1 wt %, Si≤0.2 wt %, Mn≤0.2 wt %, S≤0.01 wt %, and P≤0.01 wt %.

3. The UHSS of claim 1, wherein the composition nominally comprises 9 wt % Ni, 2 wt % Mo, 1 wt % Cr, 5 wt % Co, 1 wt % Al, 0.25 wt % C, and 81.75 wt % Fe.

4. An ultra-high strength steel (UHSS), comprising:

a composition comprising Ni in a range of about 7.0-10 wt %, Mo in a range of about 1.5-2.5%, Cr in a range of about 0.5-2 wt %, Co in a range of about 3-7 wt %, Al in a range of about 0.8-1.5 wt %, C in a range of about 0.15-0.3 wt %, and Fe in balance, wherein the UHSS is strengthened by duplex precipitates such that the UHSS has a tensile strength of about 2020 MPa, a yield strength of about 1781 MPa and a fracture toughness of about 105 MPa·$m^{1/2}$;

wherein the duplex precipitates comprise nanoscale β-NiAl and $M_2C$ precipitates, wherein M represents the metallic elements Mo and Cr; and wherein strength contributions from the $M_2C$ and β-NiAl precipitates are around 358 MPa and 280 MPa, respectively.

5. The UHSS of claim 4, wherein the composition further comprises V in a range of about 0-0.3 wt %, Nb in a range of about 0-0.1 wt %, Si≤0.2 wt %, Mn≤0.2 wt %, S≤0.01 wt %, and P≤0.01 wt %.

6. The UHSS of claim 4, wherein the composition nominally comprises 9 wt % Ni, 2 wt % Mo, 1 wt % Cr, 5 wt % Co, 1 wt % Al, 0.25 wt % C, and 81.75 wt % Fe.

7. The UHSS of claim 4, wherein the UHSS further has a solution temperature of about 1000° C.

8. A method for fabricating an ultra-high strength steel (UHSS), comprising:

providing a composition designed according to design specifications of the UHSS;

melting the composition and forging the melted composition to form an ingot;

solution-treating the forged ingot at a first temperature for a first period of time and quenching the treated ingot to room temperature;

immersing the quenched ingot in liquid $N_2$ and heating immersed ingot in air to room temperature; and subjecting the heated ingot to a tempering treatment at a second temperature for a second period of time, to obtain the UHSS having properties that are the design specifications, wherein the composition comprises Co no more than 8 wt %, Al in a range of about 0.8-1.5 wt %, Ni in a range of about 7.0-10 wt %, Mo in a range of about 1.5-2.5%, Cr in a range of about 0.5-2 wt %, C in a range of about 0.15-0.3 wt %, and Fe in balance;

wherein the UHSS is strengthened by duplex precipitates, wherein the duplex precipitates comprise nanoscale β-NiAl and $M_2C$ precipitates, wherein M represents the metallic elements Mo and Cr; and wherein strength contributions from the $M_2C$ and β-NiAl precipitates are around 358 MPa and 280 MPa, respectively.

9. The method of claim 8, wherein the composition further comprises V in a range of about 0-0.3 wt %, Nb in a range of about 0-0.1 wt %, Si≤0.2 wt %, Mn≤0.2 wt %, S≤0.01 wt %, and P≤0.01 wt %.

10. The method of claim 8, wherein the composition nominally comprises 9 wt % Ni, 2 wt % Mo, 1 wt % Cr, 5 wt % Co, 1 wt % Al, 0.25 wt % C, and 81.75 wt % Fe.

11. The method of claim 8, wherein the first temperature is in a range of about 800-1200° C., and the first period of time is in a range about 0.5-1.5 h.

12. The method of claim 11, wherein the first temperature is about 1000° C., and the first period of time is about 1 h.

13. The method of claim 8, wherein the second temperature is in a range of about 335-735° C., and the second period of time is in a range about 2-6 h.

14. The method of claim 13, wherein the second temperature is about 535° C. and the second period of time is about 4 h.

* * * * *